United States Patent [19]

Kaczmarek

[11] 4,247,056

[45] Jan. 27, 1981

[54] DEVICE FOR COMMINUTING WASTE MATERIAL

[76] Inventor: Al Kaczmarek, 136 W. Commercial Ave., Wood Dale, Ill. 60191

[21] Appl. No.: 63,538

[22] Filed: Aug. 3, 1979

[51] Int. Cl.[3] ..... B02C 18/22

[52] U.S. Cl. ..... 241/167; 83/122; 241/236

[58] Field of Search ..... 241/166, 167, 236; 83/121, 122

[56] References Cited

U.S. PATENT DOCUMENTS

| | | | |
|---|---|---|---|
| 2,969,103 | 1/1961 | Galitz | 83/122 X |
| 3,682,396 | 8/1972 | Whitney et al. | 241/166 X |
| 3,931,935 | 1/1976 | Holman | 241/167 X |
| 3,991,944 | 11/1976 | Baikoff | 241/236 X |
| 4,081,143 | 3/1978 | Johnson et al. | 241/167 X |

FOREIGN PATENT DOCUMENTS

| | | | |
|---|---|---|---|
| 655446 | 1/1938 | Fed. Rep. of Germany | 241/167 |
| 2394326 | 2/1979 | France | 241/236 |

*Primary Examiner*—Howard N. Goldberg

[57] ABSTRACT

A device for comminuting waste material, such as turnings or the like, is provided with two shafts, which are driven in opposite senses of rotation and are parallel to each other and comprise disc-shaped knives, of which the knives of one shaft engage respectively between the knives of the other shaft. The shafts are arranged in a knife box which has an upper inlet opening and a lower outlet opening and which has two external walls extending substantially parallel to the shafts. Between the knives of both shafts, stripping fingers are arranged, in the circumferential areas directed towards the external walls. The stripping fingers have a stripping end which is arranged at a short distance from the shaft and a top that is directed towards the inlet opening which is designed as a sliding surface inclined in the direction of the respective external wall of the knife box. The knife box also has by-pass openings on both sides in the sliding surface end areas.

7 Claims, 2 Drawing Figures

DEVICE FOR COMMINUTING WASTE MATERIAL

The invention relates to a device for comminuting waste material, such as turnings or the like, which device is provided with two shafts, which are driven in opposite senses of rotation and are parallel to each other and comprise disc-shaped knives, of which the knives of one shaft engage respectively between the knives of the other shaft, and provided with a knife box which has an upper inlet opening and a lower outlet opening and in which the shafts equipped with the knives are arranged and which has two external walls extending substantially parallel to the shafts.

BACKGROUND OF THIS INVENTION

When stock-removal waste, such as turnings or the like, is comminuted, the possibility of large-sized parts, such as end pieces for example, also passing into the comminuting device cannot be ruled out in practice. These parts are in many cases so hard or solid that they cannot be comminuted by the knives, so that the comminuting device is overloaded. In this event, the overload protection responds and the machine stops. The switching-on of a reversing mechanism then causes the shafts, including the knives, to be rotated in the opposite direction so that the part is moved from the working gap of the knives to the top and to the side. When the machine is switched on again, the part now passes again into the knife working gap and, if it is of sufficient strength, once more causes a machine stoppage involving an overload switch-off. This process is repeated until the part has been removed from the comminuting device, so that considerable impairments of the waste comminution are caused. Another disadvantage consists in the fact that a repeated machine blockage by the same part increases the wear of the knives.

OBJECTS AND STATEMENT OF THE INVENTION

Accordingly, the task of the invention consists in designing a comminuting device of the kind described at the beginning in such a way that there is ensured a run of the comminuting device which is largely free of stoppages and the removal of the obstructing parts by machine.

According to the invention, this task is solved in that there are arranged between the knives of both shafts, in the circumferential areas which are directed towards the external walls, stripping fingers which have a stripping end arranged at a short distance from the shaft and whose top that is directed towards the inlet opening is designed as a sliding surface which is inclined in the direction of the respective external wall of the knife box, and in that the knife box has by-pass openings in the sliding surface areas on both sides.

By this means, the following advantages are attained:

(a) In the event of an overload switching-off of the comminuting device, the obstructing part is conducted away through the stripping fingers when the knives are reversed, so that it cannot pass once more into the knife working gap when the device is re-started.

(b) A repeated machine stoppage caused by the same obstructing part is avoided, so that there is ensured a waste comminution that is largely free from interference.

(c) The obstructing part slides constrainedly on the inclined surface of the stripping fingers on account of its own weight.

(d) Due to the by-pass openings provided in the sliding surface end areas, the obstructing part is reliably removed from the knife box.

(e) On account of the close abutment of the stripping ends against the shafts, it is ensured that an obstructing part which is located between the knives on the shaft circumference is also removed to the outside and that any jamming is avoided.

(f) The service life of the knives is prolonged. Wear and damage are reduced. Repair costs are saved.

(g) The efficiency, and thus the economy, is increased considerably on account of the fewer overload switch-offs and the long service life of the knives.

(h) The stripping fingers support the shafts on the outside if too much stock is fed into the knife working gap.

The invention also discloses the following advantageous features:

At the beginning of the sliding surface, there is arranged in the horizontal plane of the shaft axis the stripping end upper edge that is directed towards the inlet opening. These features ensure that no waste parts will be squeezed between the stripping end of the stripping fingers and the shaft circumferential surface when reversing is effected, as would have to be feared if the upper edge of the stripping end were located beneath the horizontal plane since there would then be formed a funnel-shaped drawing-in area. In the invention, setting is effected, similar to the setting of a turning tool on a lathe, substantially in the axial horizontal plane of the rotating body.

The stripping end lower edge that is directed towards the outlet opening is arranged in the vertical plane of the shaft axis closely beneath the lower vertex of the shaft. These features ensure that in the normal working direction of rotation of the shafts, the comminuted material is stripped beneath the shaft at the lower vertex thereof. A funnel-like drawing-in and squeezing is thus also reliably avoided.

The stripping end comprises between the upper edge and the lower edge a concave arched surface which is directed towards the shaft and whose radius is only slightly larger than the radius of the shaft. Due to these features, the stripping end of the stripping fingers is closely adapted to the circumferential surface of the rotating shaft. It is therefore impossible for any large-sized waste parts to become stuck. The shafts are straight and are not bent inwardly towards each other transversely to the axis. Due to the arched surface at the stripping ends, the shafts are externally supported, similar to slide bearings, if high bending stresses are caused in the knife working gap by a considerable stock allowance.

The stripping fingers are welded to the sliding surface end area and the hardness thereof is greater in the stripping end than it is in the sliding surface end area. Due to these features, the stripping ends are largely protected against wear because of their greater hardness, while in the sliding surface end area the welded-on stripping fingers are more elastic to bending, on account of their lesser hardness, and cannot break off. The bending elasticity is brought about simultaneously with the welding-on operation, an additional after-hardening being dispensed with.

Adjacent to the by-pass openings, there are provided diversion channels which are bounded in the downward direction by inclined surfaces as extensions of the external walls of the knife box. Due to these features, a direct feeding of the obstructing parts through the diversion channels into the waste collecting bin is ensured upon the reversal of the knives, the diversion being effected in a simple construction over chute-like inclined surfaces.

Outlet openings are provided in the inclined surfaces of the diversion channels and lids are provided for shutting the outlet openings. These features ensure that the obstructing parts are not conducted into the waste collection bin but are collected in separate boxes so that a satisfactory separation is provided.

DESCRIPTION OF THE DRAWINGS

The invention will now be described with reference to a preferred exemplified embodiment shown in the drawings, in which.

DETAILED DESCRIPTION OF THE INVENTION

Figure 1:
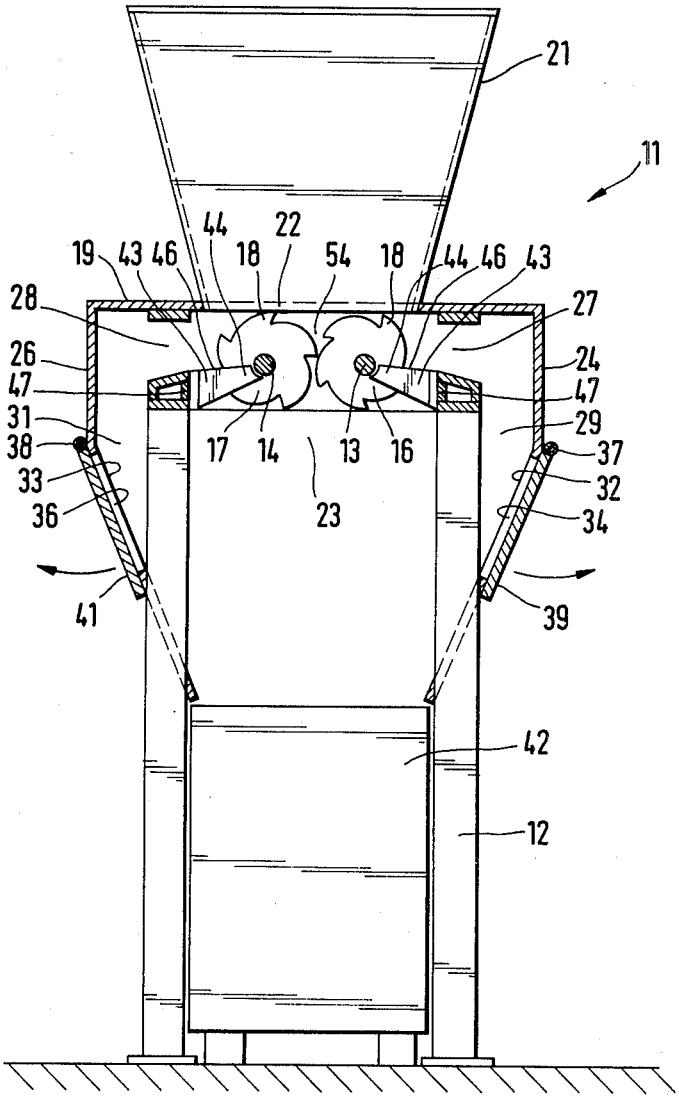
FIG. 1 shows a partially sectional side view of a comminuting device according to the invention.

The comminuting device 11 for turnings or the like shown in FIG. 1 possesses a base frame 12, on which there are mounted two shafts 13, 14 which are parallel to each other. The shafts 13, 14 are driven in opposite senses of rotation by a motor, a gearing being connected therebetween. Disc-shaped knives 16, 17, which are provided with teeth 18, are arranged on the shafts 13, 14. The arrangement of the knives 16, 17 is such that the knives 16 of the right-hand shaft 13 engage between the knives 17 of the left-hand shaft 14 and the knives 17 engage between the knives 16.

The shafts 13, 14 provided with the knives 16, 17 are located in a knife box 19, on which a feed hopper 21 is arranged and which comprises an upper inlet opening 22 as well as a lower outlet opening 23. The external walls 24, 26 of the knife box 19, which extent parallel to the shafts 13, 14, are arranged at a distance from the knives 16, 17. In the area between the knives 16, 17 and the external walls 24, 26, there are formed on both sides by-pass openings 27, 28 which extend parallel to the shafts 13, 14 over the entire length of the knife box 19 and which are adjoined by downwardly directed diversion channels 29, 31. The diversion channels 29, 31 are bounded in the downward direction, as extensions of the external walls 23, 24, by inclined surfaces 32, 33, wherein there are provided outlet openings 34, 36 which are shut by lids 39, 41 which are pivotally mounted on hinges 37, 38. The inclined surfaces 32, 33 end closely above a collecting bin 42 which is disposed between the base frame 12.

Between the knives 16, 17, there are arranged stripping fingers 43 which have a stripping end 44, which is arranged at a short distance from the shaft 13 or 14, and extend in the direction of the respective outer wall 23 or 24. The top of the stripping fingers 43 that is directed towards the inlet opening 22 is designed as a sliding surface 46 which is inclined in the direction of the diversion channels 29, 31. At the end of the sliding surface 46, in the area of the by-pass opening 27 or 28, the stripping fingers 43 are welded to a frame part 47 at the base frame end, the hardness of the stripping fingers 43 being considerably greater at the stripping end 44 than in the area of the welded fastening.

Figure 2:
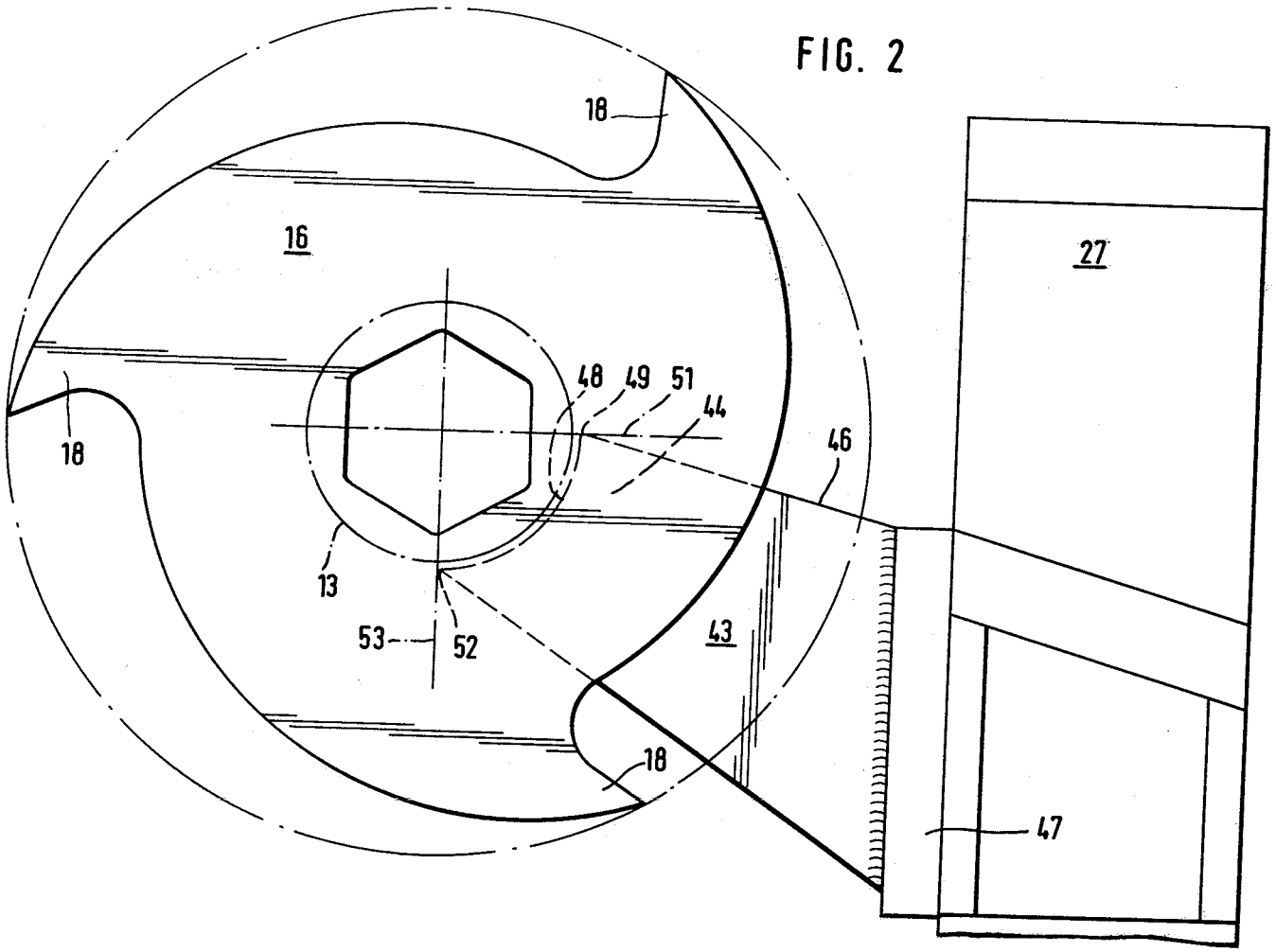
FIG. 2 shows an enlarged representation of the knife shaft that is on the right-hand side in FIG. 1, together with the stripping finger.

As can be seen particularly clearly in FIG. 2, the stripping end 44 of the stripping fingers 43 possesses a concave arched surface 48 which is provided close to the circumference of the shaft 13 or 14 and whose radius is only slightly larger than the radius of the shaft 13 or 14. It is furthermore discernible that the upper edge 49 of the stripping end 44 is arranged in the horiontal plane 51 of the shaft axis and the lower edge 52 in the vertical plane 53 thereof close to the lower vertex of the shaft 13 or 14.

The turnings to be comminuted pass via the feed hopper 21 through the inlet opening 22 into the knife working gap 54, are cut into pieces therein by the teeth 18 of the knives 16, 17 and drop downwards through the outlet opening 23 into the collecting bin 42. If a large-sized solid obstructing part, which cannot be comminuted by the knives 16, 17 passes into the knife working gap 54, the reversing mechanism is switched on so that the knives 16, 17 rotate outwardly in the opposite direction. During this process, the obstructing part is picked up by the stripping fingers 43 and passes over the sliding surface 46 through one of the by-pass openings 27, 28 and one of the diversion channels 29 or 31 into the collecting bin 42. It is also possible to collect such obstructing parts separately. To this end, the lids 39, 41 are pivoted open in the direction of the arrows and the obstructing part dropping through the outlet opening 34 or 36 is conducted into an additional collecting bin.

What I claim is:

1. A device for comminuting waste material, such as turnings or the like, comprising:
   - two shafts which are driven in opposite senses of rotation and are parallel to each other and comprise disc-shaped knives of which the knives of one shaft engage respectively between the knives of the other shaft,
   - a knife box which has an upper inlet opening and a lower outlet opening and in which the shafts equipped with the knives are arranged,
   - two external walls extending substantially parallel to the shafts,
   - stripping fingers arranged between the knives of both shafts in the circumferential areas directed towards the external walls,
   - the stripping fingers having a stripping end which is arranged at a short distance from the shaft and a top that is directed towards the inlet opening which is designed as a sliding surface and is inclined and has a sliding surface end area in the direction of the respective external wall of the knife box, and
   - the knife box having by-pass openings on both sides in the sliding surface end areas of the stripping fingers.

2. A device as claimed in claim 1, in which the shaft has an axis arranged in a horizontal plane and at the beginning of the sliding surface, the stripping end has an upper edge that is directed towards the inlet opening and is arranged in the horizontal plane of the shaft axis.

3. A device as claimed in claims 1 or 2, in which the shaft has a lower vertex and the stripping end has a lower edge that is directed towards the outlet opening and is arranged closely beneath the lower vertex of the shaft.

4. A device as claimed in claim 3, in which the stripping end comprises a concave arched surface between the upper edge and the lower edge, which is directed towards the shaft and whose radius is only slightly larger than the radius of the shaft.

5. A device as claimed in one of claims 1 or 2 in which the stripping fingers are welded at the sliding surface end area and the hardness thereof is greater in the stripping end than it is in the sliding surface end area.

6. A device as claimed in claim 1 in which diversion channels are provided adjacent to the by-pass openings, which are bounded in the downward direction by inclined surfaces as extensions of the external walls of the knife box.

7. A device as claimed in claim 6, in which outlet openings are provided in the inclined surfaces of the diversion channels and lids are provided for shutting the outlet openings.

* * * * *